US006698250B2

(12) United States Patent
Lonati et al.

(10) Patent No.: US 6,698,250 B2
(45) Date of Patent: Mar. 2, 2004

(54) CIRCULAR KNITTING MACHINE WITH KNITTED ITEM REMOVAL/TRANSFERRING DEVICE

(75) Inventors: Ettore Lonati, Brescia (IT); Tiberio Lonati, Brescia (IT); Fausto Lonati, Brescia (IT)

(73) Assignee: Lonati S.p.A., Brescia (IT)

( * ) Notice: Subject to any disclaimer, the term of this patent is extended or adjusted under 35 U.S.C. 154(b) by 0 days.

(21) Appl. No.: 10/459,526

(22) Filed: Jun. 12, 2003

(65) Prior Publication Data

US 2003/0233852 A1 Dec. 25, 2003

(30) Foreign Application Priority Data

Jun. 24, 2002 (IT) ..... MI2002A1384

(51) Int. Cl.[7] ..... D04B 9/40
(52) U.S. Cl. ..... 66/149 S; 66/148; 66/59
(58) Field of Search ..... 66/147, 148, 149 R, 66/150, 152, 153, 149 S, 13, 14, 17, 18, 58, 59, 8

(56) References Cited

U.S. PATENT DOCUMENTS 3,826,111 A * 7/1974 Peberdy ..... 66/149 S
3,841,112 A * 10/1974 Uhlir et al. ..... 66/149 S
4,516,410 A * 5/1985 Lonati ..... 66/149 S
5,235,825 A * 8/1993 Turini ..... 66/149 S
5,924,309 A * 7/1999 Conti ..... 66/148
6,164,091 A * 12/2000 Frullini et al. ..... 66/148
6,389,849 B1 * 5/2002 Conti ..... 66/148

FOREIGN PATENT DOCUMENTS

| | | |
|---|---|---|
| EP | 0 516 049 | 12/1992 |
| EP | 0 942 086 | 9/1999 |
| WO | 97 28300 | 8/1997 |

* cited by examiner

*Primary Examiner*—Danny Worrell
(74) *Attorney, Agent, or Firm*—Guido Modiano; Albert Josif; Daniel O'Byrne

(57) ABSTRACT

A circular double-cylinder hosiery knitting machine with a device for removing and transferring the article at the end of the knitting process, comprising a lower and an upper needle cylinders with vertical axis, a device with a removal element insertable from above into the upper needle cylinder, provided with first grippers that engage the final end of the article and a transfer element, arranged above the upper needle cylinder to remove the article from the removal element and to feed it to a sewing machine.

29 Claims, 12 Drawing Sheets

CIRCULAR KNITTING MACHINE WITH KNITTED ITEM REMOVAL/TRANSFERRING DEVICE

BACKGROUND OF THE INVENTION

The present invention relates to a circular double-cylinder hosiery knitting machine with device for removing and transferring the article at the end of the knitting process, particularly for automating the closure of the toe of hosiery items.

As is known, according to conventional manufacturing processes tubular articles, particularly hosiery items, are generally manufactured by means of circular machines and are unloaded from the machine that manufactures them with both axial ends open. These articles must therefore be subjected to a subsequent sewing or looping operation, which closes one end of the article, constituted by the toe for hosiery items, in order to obtain the finished product.

Since this operation for closing an axial end of the article is an additional production step that requires time and the use of labor, with the associated costs, in recent years methods have been devised and perfected which seek to close one end of the article directly on the manufacturing machine or to automate the transfer of the article from the manufacturing machine to a sewing or looping machine, so as to reduce the overall manufacturing costs of the articles.

The methods that consist in closing an axial end of the article, directly on the manufacturing machine, have the drawback that they penalize considerably the production potential of the machine, since the time required to close the article is a time during which the machine cannot proceed with the production of other articles.

The methods that automate the transfer of the article from the manufacturing machine to a looping or sewing machine and therefore close an axial end of the article externally with respect to the manufacturing machine have the advantage that they allow, after removing the article from the manufacturing machine, to resume production on the part of the machine; therefore they penalize to a lesser extent the production potential of the machine. However, these methods still penalize significantly the productivity of the machine, since the removal of the article from the manufacturing machine still requires a certain time, which cannot be used for manufacturing.

SUMMARY OF THE INVENTION

The aim of the present invention is to solve the problems cited above, by providing a circular double-cylinder hosiery knitting machine with a device for removing and transferring the article at the end of the knitting process, particularly for automating the operation of closing the toe of hosiery items, which allows to reduce considerably the time taken away from the manufacturing of the machine, so as to not penalize, or penalize minimally, the productivity of the machine.

Within this aim, an object of the invention is to provide a circular double-cylinder hosiery knitting machine that allows to achieve correct closure of the toe of hosiery item even in the case of high-gauge hosiery items.

Another object of the invention is to provide a method for the automated transfer of a tubular article, particularly a hosiery item, from a circular double-cylinder machine to a sewing machine, which makes it economically convenient to perform this transfer.

Another object of the invention is to provide a circular double-cylinder hosiery knitting machine with a device for removing and transferring the article at the end of the knitting process that is highly reliable and precise in operation.

This aim and these and other objects that will become better apparent hereinafter are achieved by a circular double-cylinder hosiery knitting machine with a device for removing and transferring the article at the end of the knitting process, particularly for automating the closure of the toe of hosiery items, which comprises a lower needle cylinder, which has a vertical axis, and an upper needle cylinder, which is arranged above said lower needle cylinder and coaxially thereto, said needle cylinders being actuatable with a rotary motion about their own axis, characterized in that it comprises a device that is provided with a removal element that can be inserted from above into the upper needle cylinder and is provided with first grip means that can engage a region of the article being manufactured that is proximate to the final end of said article, said removal element being removable upwardly from the upper needle cylinder in order to move the article away from the machine, a transfer element being further provided which is arranged above the upper needle cylinder and is adapted to remove the article from said removal element and to feed it to a sewing machine in order to close said final end of the article.

BRIEF DESCRIPTION OF THE DRAWINGS

Further characteristics and advantages of the invention will become better apparent from the description of a preferred but not exclusive embodiment of the machine according to the invention, illustrated only by way of non-limitative example in the accompanying drawings, wherein.

DESCRIPTION OF THE PREFERRED EMBODIMENTS

Figure 1:
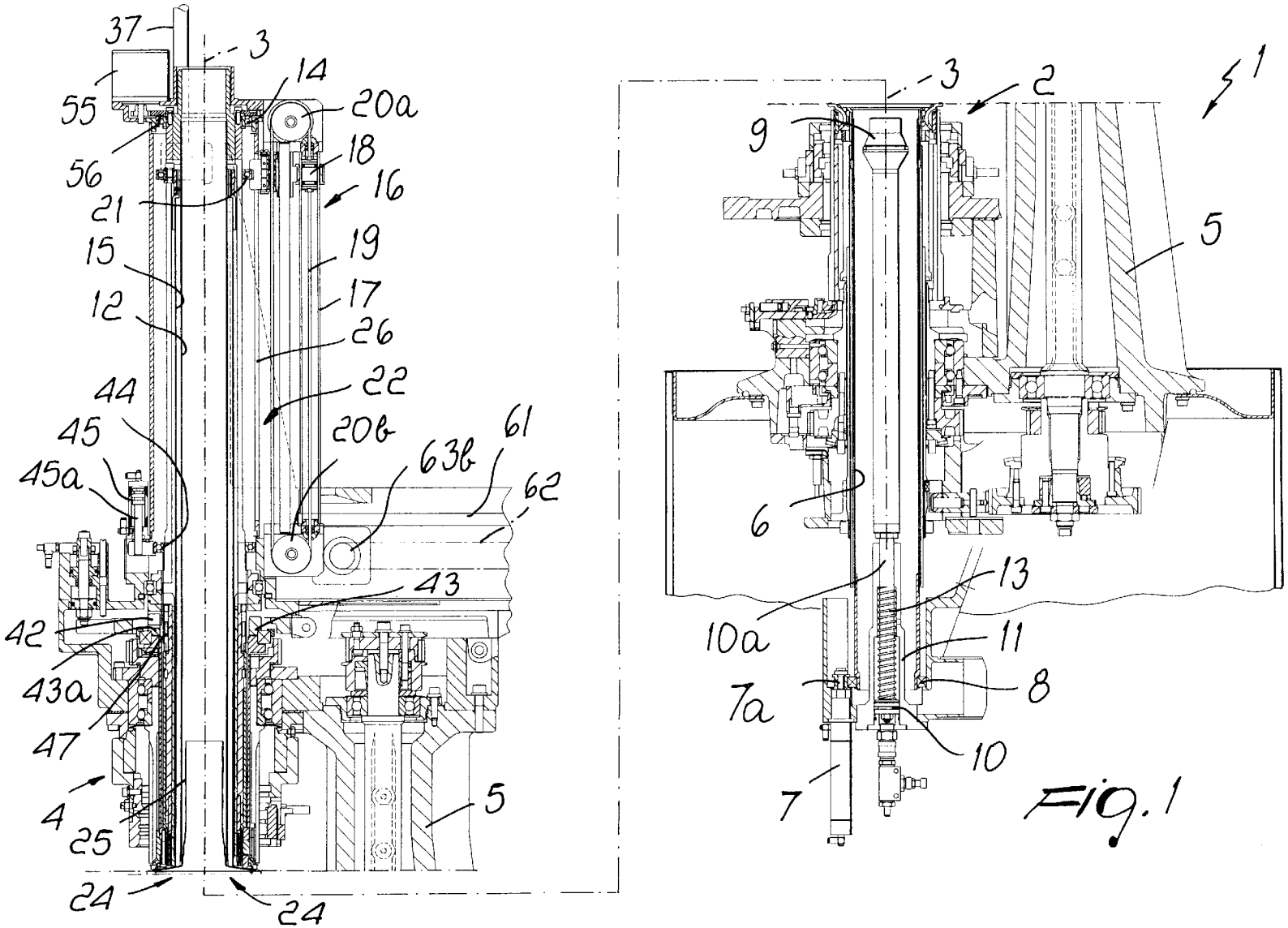
FIG. 1 is a schematic axial sectional view of the machine according to the invention, illustrating a part of the device for removing and transferring the article before said device begins working.
Figure 2:
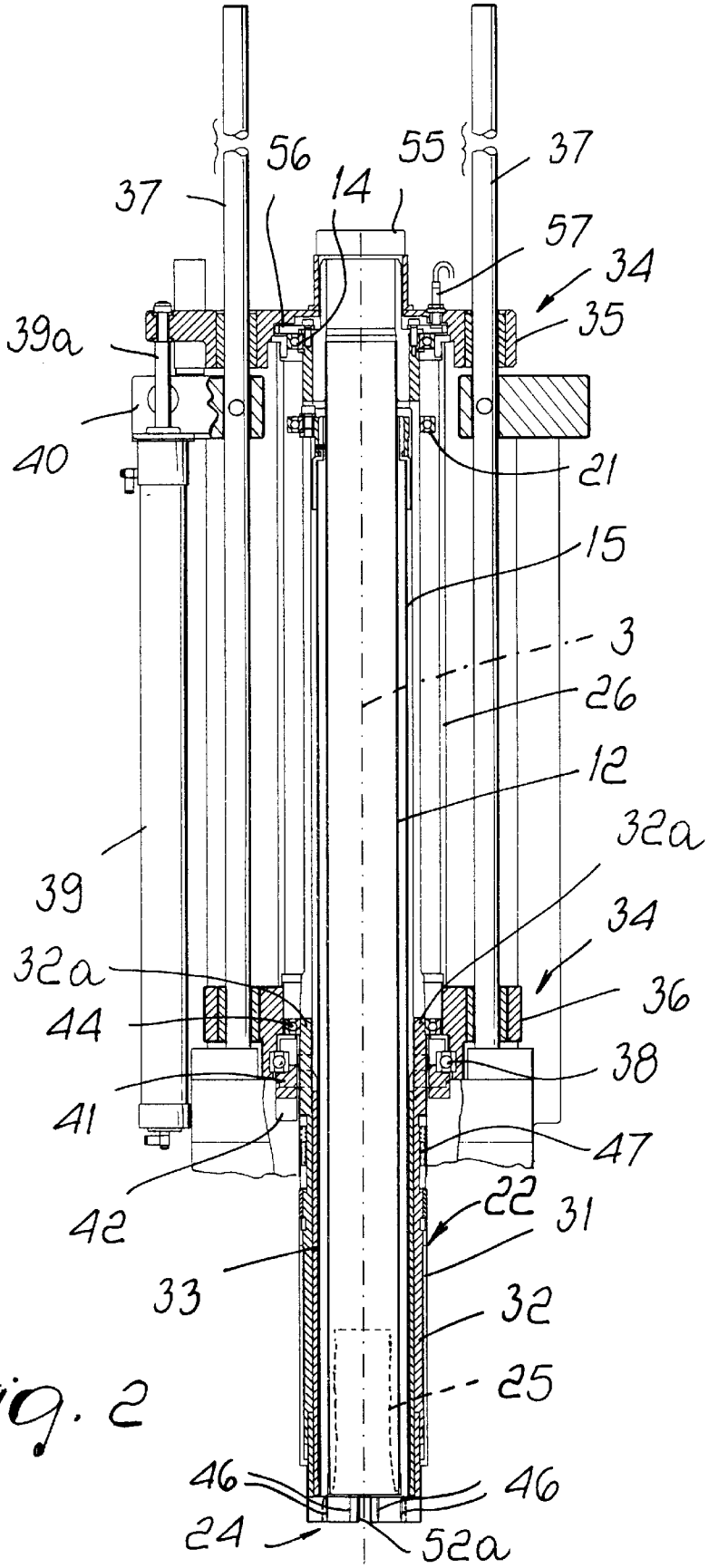
FIG. 2 is a schematic axial sectional view of the removal element in its operating position that corresponds to its complete insertion in the upper needle cylinder of the machine.

With reference to the figures, the circular double-cylinder hosiery knitting machine according to the invention, generally designated by the reference numeral 1, comprises in a per se known manner a lower needle cylinder 2, whose axis 3 is orientated vertically, and an upper needle cylinder 4, which is arranged above the lower needle cylinder 2 and coaxially thereto.

The lower needle cylinder 2 and the upper needle cylinder 4 are supported by a supporting structure 5 so that they can rotate about the axis 3, and they can be actuated, in a per se known manner, with a rotary motion about the axis 3.

In a per se known manner, the lower needle cylinder 2 and the upper needle cylinder 4 contain a device for tensioning the article. Said article tensioning device comprises a lower suction tube 6, referenced hereinafter as "lower tube" for the sake of brevity, which is arranged internally and coaxially with respect to the lower needle cylinder 2. The lower tube 6 is rigidly coupled to the lower needle cylinder 2 in rotation about the axis 3 and can move on command along the axis 3 with respect to the lower needle cylinder 2.

More particularly, the lower tube 6 is supported, so that it can slide axially, inside the lower needle cylinder 2 and is connected, proximate to its lower end, to the stem 7*a* of the piston of a pneumatic cylinder 7, which is supported by the supporting structure 5 of the machine and is orientated so that one of its axes is parallel to the axis 3. A bearing 8 is conveniently arranged between the stem 7*a* and the lower tube 6 in order to allow the rotation of the lower tube 6 about the axis 3.

The stroke of the pneumatic cylinder 7 is such as to allow to move the lower tube 6 from a lowered position, in which its upper end lies directly below the upper end of the lower needle cylinder 2, to a raised position, in which the lower tube 6 protrudes partly into the upper needle cylinder 4, and vice versa.

A plug-like element 9 is accommodated internally and coaxially to the lower tube 6. Said plug-like element 9 can move on command along the axis 3 with respect to the lower tube 6 and to the lower needle cylinder 2. More particularly, the plug-like element 9 is fixed to the upper end of the stem 10*a* of the piston 10 of a pneumatic cylinder 11, which is associated with the supporting structure of the machine.

The plug-like element 9 can move, by virtue of the action of the pneumatic cylinder 11, along the axis 3 from an inactive position, in which it is fully accommodated within the lower needle cylinder 2 and is spaced downward from the upper end of said lower needle cylinder 2, to an active position, in which it engages the lower end of an upper suction tube 12, referenced hereinafter as "upper tube" for the sake of brevity, which is accommodated in the upper needle cylinder 4, as will become better apparent hereinafter.

The piston 10 of the pneumatic cylinder 11 can move upward in contrast with a spring 13 that actuates the descent of the plug-like element 9 when the pneumatic cylinder 11 is discharged.

The upper tube 12, which is also part of the article tensioning device, is arranged above the upper needle cylinder 4 and coaxially thereto and protrudes with its lower end into the upper needle cylinder 4.

A tensioning tube 15 is arranged around the upper tube 12 and can move on command, in a per se known manner, along the axis 3 in order to pass from a raised position, in which its lower end is level with, or arranged above, the lower end of the upper needle cylinder 4, to a lowered position, in which its lower end protrudes inside the lower needle cylinder 2 around the plug-like element 9.

The movement of the tensioning tube 15 can be actuated, in a per se known manner, by way of a pneumatic device, generally designated by the reference numeral 16, which is substantially constituted by a pneumatic cylinder 17, which is provided with a piston 18, which is in turn connected, at its axial ends, to the ends of a cable or belt 19. The cable or belt 19 winds around two pulleys 20*a* and 20*b*, which have horizontal axes, so that one portion of said cable, which runs between the pulleys 20*a* and 20*b*, is arranged vertically laterally to the tensioning tube 15. Said portion is connected, with the interposition of a bearing 21, to the tensioning tube 15 so that the actuation of the pneumatic cylinder 17 causes the upward or downward axial translational motion of the tensioning tube 15.

The lower tube 6 can be connected on command, in a per se known manner, to suction means, and likewise the upper tube 12 can be connected to suction means in order to generate, when required, a partial vacuum inside said tubes 6 and 12.

The double-cylinder knitting machine is not described further, since it can be constituted by a circular double-cylinder knitting machine of a known type with a fabric tensioning device. For example, the machine can be constituted by a double-cylinder machine of the type disclosed in U.S. Ser. No. 08/595,112 by the same Applicant.

The machine according to the invention comprises a device for removing and transferring the article at the end of the knitting process.

Said removal and transfer device comprises a removal element, generally designated by the reference numeral 22, and a transfer element, generally designated by the reference numeral 23.

The removal element 22 can be inserted from above into the upper needle cylinder 4 and is provided with first grip means 24, which can engage a region of the article 25 being manufactured that is proximate to the final end of said article 25 and can be extracted upwardly from the upper needle cylinder 4 in order to move the article 25 away at the end of its knitting.

The transfer element 23 is arranged above the upper needle cylinder 4, and is adapted to remove the article 25 from the removal element 22 and feed it to a sewing machine that is capable of closing the final end of the article 25, as will become better apparent hereinafter.

The removal element 22 includes internally the upper tube 12, which as mentioned can be connected on command to suction means to form aspirating means. In this manner, the removal element 22 comprises means for aspirating the article 25 that allow to aspirate the article 25 upward inside said upper tube 12, so as to arrange the article 25 upside down.

The removal element 22 substantially comprises a hollow outer cylinder 31 ("outer cylinder" for the sake of brevity), a hollow intermediate cylinder 32 ("intermediate cylinder" for the sake of brevity), and a hollow inner cylinder 33 ("inner cylinder" for the sake of brevity), which are coaxial and are supported by a supporting structure 34 so that they can rotate about their own axis, which coincides with the axis 3. Said supporting structure 34 is substantially composed of an upper head 35 and a lower head 36, which are connected to each other by vertical rods, not shown in the figures, and by a housing 26, which surrounds the upper part of the removal element 22. The upper head 35 and the lower head 36 are slidingly supported by vertical guiding columns 37, which are fixed to the supporting structure of the machine above the upper needle cylinder 4.

The inner cylinder 33 is rigidly coupled to the inner tube 12 and is supported, together with said inner tube, so as to allow rotation about the axis 3, by the upper head 35, by interposing a bearing 14, and by the lower head 36, by interposing a bearing 38. The upper head 35 is connected to the stem 39*a* of a pneumatic cylinder 39, which is fixed by means of its body to a block 40 that is rigidly coupled to one of the guiding columns 37 and is arranged so that its axis is parallel to the axis 3. By actuating the pneumatic cylinder 39, i.e. on command, the assembly constituted by the outer cylinder 31, the intermediate cylinder 32 and the inner cylinder 33, and by the upper tube 12 and the tensioning tube 15 together with its actuation device 16, is made to perform a translational motion along the axis 3.

Said assembly constituted by the three cylinders 31, 32 and 33 can be connected, in its rotation about the axis 3, to the upper needle cylinder 4. More particularly, the inner cylinder 33 is provided with a flange 41, which protrudes outside the intermediate cylinder 32 and the outer cylinder 31 and to which a tooth 42 is fixed which, when the removal element 22 is inserted in the upper needle cylinder 4, engages in a seat 43a provided, in a specific angular position around the axis 3, in a flange 43 that is rigidly coupled to the upper needle cylinder 4.

The cylinders 31, 32 and 33 are jointly coupled, in rotation about the axis 3, by using tabs or rotational couplings of another kind, which are only partially visible in the figures. Furthermore, the intermediate cylinder 32 can move axially with respect to the inner cylinder 33. More particularly, the intermediate cylinder 32 has, at its upper end, at least one extension 32*a*, which passes through suitable passages formed in the flange 41 and is fixed to the inner ring of a bearing 44.

The outer ring of the bearing 44 is connected to the stem 45*a* of the piston of a pneumatic cylinder 45, which is arranged so that its axis is parallel to the axis 3 and is mounted on the supporting structure 34. The first grip means 24 comprise punches 46, which are fixed to the lower end of the intermediate cylinder 32 and are orientated so that their tip is directed downward.

The actuation of the pneumatic cylinder 45, that constitutes actuation means for the intermediate cylinder, causes the translational motion, along the axis 3, of the intermediate cylinder 32 with respect to the inner cylinder 33 in order to achieve its passage from an inactive position, in which the punches 46 are arranged so that their tip is at a higher level than the lower end of the inner cylinder 33, to an active position, in which the punches 46 are arranged so that their tip lies below the lower end of the inner cylinder 33 in order to engage them with the article 25, as will become better apparent hereinafter.

The outer cylinder 31 can move axially with respect to the intermediate cylinder 32 in order to pass from a raised position, in which it is arranged with its lower end substantially at the level of the tip of the punches 46, to a lowered position, in which it is arranged so that its lower end lies below the lower end of the punches 46.

Elastic means are interposed between the intermediate cylinder 32 and the outer cylinder 31 and are constituted, in the illustrated embodiment, by spring-loaded pistons 47, which contrast the passage of the outer cylinder 31 from the lowered position to the raised position.

It should be noted that the outer cylinder 31 has, on its cylindrical wall, an axial shoulder 48 which, when the removal element 22 is inserted in the upper needle cylinder 4, is designed to rest against an abutment 49 provided correspondingly on the inner cylindrical wall of the upper needle cylinder 4. Said outer cylinder 31 is further provided, on its inner cylindrical wall, with an abutment 50 that is adapted to be engaged by an axial shoulder 51 provided on the outer cylindrical wall of the intermediate cylinder 32 in order to delimit the downward stroke of the intermediate cylinder 32 when the removal element 22 is accommodated inside the upper needle cylinder 4.

The first grip means 24 comprise at least two pairs of grip elements, which can engage two diametrically opposite regions of the article 25. The grip elements of a same pair are spaced one another, so as to leave a portion of the article 25 free between the two grip elements of a same pair.

In the illustrated embodiment, in which the first grip means are constituted by the punches 46, there are at least two pairs of punches, which are arranged in two diametrically opposite regions at the lower end of the intermediate cylinder 32. The punches of a same pair are spaced one another so as to leave free a portion of the article 25 between the two punches of a same pair. Furthermore, the outer cylinder 31 has, at these regions, two passages 52*a* and 52*b*, which are arranged in two diametrically opposite regions starting from the lower end of the outer cylinder 31, so as to allow second grip means 53 of the transfer element 23, described in greater detail hereinafter, to act on the article 25.

Conveniently, first means are provided for locking the article 25 before it is engaged by the first grip means 24. Said first locking means can engage a region of the article 25 that is closer to the axis of the article 25 than the region that can be engaged by the first grip means 24.

More particularly, the first locking means cited above comprise the plug-like element 9, which by way of the actuation of the piston 10 of the pneumatic cylinder 11 can engage the lower end of the upper tube 12, while the article 25 is aspirated into said upper tube so as to lock said article 25.

The plug-like element 9, again thanks to its ability to move axially by actuation of the pneumatic cylinder 11, can follow at least partially or move jointly with the removal element 22 during its upward motion when the removal element 22 is extracted from the upper end of the upper needle cylinder 4.

Advantageously, there are also second means for locking the article 25 before it is engaged by the first grip means 24. Said second locking means can engage a region of the article 25 that is located between the region that can be engaged by the first grip means 24 and the region that can be engaged by the first locking means.

Said second locking means comprise the lower tube 6, which thanks to its ability to perform a translational motion along the axis 3, actuated by way of the pneumatic cylinder 7, can engage against the lower end of the inner cylinder 33.

The lower end of the inner cylinder 33 is conveniently shaped so as to allow effective locking of the article 25 on the part of the upper end of the lower tube 6.

It should be noted that the lower end of the inner cylinder 33 can be shaped in a different manner along its circumferential extension, so as to allow correct engagement of the article 25 between the inner cylinder 33 and the lower tube 6 despite the presence of various shaped portions of the article 25 along its circumferential extension. For example, in the case of hosiery items, it is possible to provide a different shape of the lower end of the inner cylinder 33, so as to allow to grip the article correctly even in regions, for example at the toe, where there is an excess of knitting.

The lower tube 6, by virtue of the action of the pneumatic cylinder 7, can follow at least partially or move jointly with the removal element 22 during its upward motion when it is extracted upward from the upper needle cylinder 4, so as to maintain the locking of the article 25 at least along part of said upward motion.

As mentioned, the removal element 22, particularly the assembly constituted by the outer cylinder 31, the intermediate cylinder 32, and the inner cylinder 33, can be coupled, in rotating about the axis 3, to the upper needle cylinder 4 by way of the coupling of the tooth 42 within the seat 43*a* in a preset angular position about the axis 3. This assuredly allows engagement of the punches 46 with specific regions of the article that substantially correspond to the lateral ends of the opening of the article to be closed through the subsequent sewing operation. In the case of hosiery items, said regions are constituted by the ends of the opening of the toe to be closed.

In order to allow the correct coupling of the tooth 42 with the seat 43*a* and allow correct positioning of the removal element 22 with respect to the transfer element 23, there are means for actuating the removal element 22 with a controlled rotary motion about the axis 3 with respect to the supporting structure 34. Said actuation means comprise a motor 55, which is mounted on the supporting structure 34 and is connected, by way of its output shaft, to a gear 56, which is keyed on an extension of the inner cylinder 33. The motor 55 is a motor of the electric type, for example a step motor or a brushless motor, in which the angular rotation can be controlled, and said motor can be optionally connected, by means of an electronic control system of the axis-following type, to the motor for actuating the needle cylinders 2 and 4 so as to assuredly achieve, during the insertion of the removal element 22 in the upper needle cylinder 4, an alignment of the tooth 42 with the seat 43*a*. The angular position of the inner cylinder 33 and therefore of the entire assembly constituted by the cylinders 31, 32 and 33 can also be controlled directly by means of a known type of sensor 57.

The number of punches 46 can vary according to the requirements, but without changing the presence of two pairs of punches that can engage two diametrically opposite regions of the article 25. As an extreme option, it is possible to provide a ring of punches 46 that runs all around the axis 3, although, as shown, a smaller number of punches 46 is sufficient to keep free from the article 25 the regions of said article that have to be engaged by the second grip means 53, i.e., the regions located between the punches of the two pairs of punches that can engage two mutually diametrically opposite regions of the article 25.

The transfer element 23 can move on command, i.e. upon selective and purposely actuation, along a substantially horizontal transfer direction 58 from a position for gripping the article 25, in which it is arranged with the second grip means 53 below the lower end of the removal element 22 in the position in which it is extracted upwardly from the upper needle cylinder 4, to a transfer position, in which it is moved laterally away from the upper needle cylinder 4, and vice versa.

More particularly, the transfer element 23 is mounted on a supporting structure 60, which is in turn mounted so that it can slide on horizontal guiding bars 61. The supporting structure 60 is further fixed to the portion of a toothed belt 62 that winds around a pair of pulleys 63*a* and 63*b* that have horizontal and mutually parallel axes. One of these pulleys, the pulley 63*b* in the illustrated embodiment, is connected to the output shaft of an electric motor, which can be actuated in order to produce the sliding, in one direction or in the opposite direction, of the supporting structure 60 along the guiding bars 61.

Furthermore, the supporting structure 60 is formed by multiple parts that move with respect to each other. More particularly, the supporting structure 60 is composed of a sliding element 64, which can only perform a translational motion along the guiding bars 61 and is fixed to the portion of the belt 62. The sliding element 64 supports, so that it can rotate about a horizontal axis 65, a supporting element 66, which supports the second grip means 53. Said supporting element 66 is provided with a sleeve 67, whose axis coincides with the axis 65 and is supported, by interposing bearings 68, so that it can rotate about the axis 65 on the part of the sliding element 64. A pinion 69 is keyed on said sleeve 67, and a rack 70 engages therewith and is actuated by means of a pneumatic actuator 71. The actuation of said pneumatic actuator 71 causes the rotation of the supporting element 66, and therefore of the second grip means 53, about the axis 65 in order to overturn the article 25, which is engaged by the second grip means 53, as will become better apparent hereinafter.

The second grip means 53 of the transfer element 23 comprise two grippers, respectively a first gripper 54*a* and a second gripper 54*b*, which are mounted on said supporting element 66 and can move together with it along the guiding bars 61.

Furthermore, the two grippers 54*a* and 54*b* can also move along a substantially vertical direction with respect to the supporting element 66, so as to enter with a jaw of each one of the grippers through the lower end of the outer cylinder 31.

The inner or first jaw 72*a* of the first gripper 54*a* is fixed to the supporting element 66, so as to perform a translational motion rigidly therewith along the transfer direction 58, while the other or second jaw 73*a* of said first gripper 54*a* is connected to the piston 74*a* of a pneumatic cylinder 75*a*, which can be actuated to move the jaw 73*a* toward or away from the jaw 72*a*.

Likewise, the second gripper 54*b* is also constituted by a first jaw 72*b*, is which is rigidly coupled, in translational motion along the transfer direction 58, to a portion 66*a* of the supporting element 66. The other, second jaw 73*b*, in this second gripper 54*b*, is connected to the piston 74*b* of a pneumatic cylinder 75*b*, which can be actuated to move the jaw 73*b* toward or away from the jaw 72*b*. The jaws 72*a* and 73*a* of the first gripper, together with the pneumatic cylinder 75*a* that actuates the jaw 73*a*, are in turn mounted on the piston 76*a* of another pneumatic cylinder 77*a*, which has a vertical axis and can be actuated in order to lift and lower the first gripper 54*a*. The body of this pneumatic cylinder 77*a* is formed directly in the supporting element 66.

Likewise, the jaws 72*b* and 73*b* of the second gripper 54*b* are in turn mounted, together with the pneumatic cylinder 77*b* that actuates the jaw 73*b*, on the piston 76*b* of another pneumatic cylinder 77*b*, which has a vertical axis and can be actuated so as to lift and lower said second gripper 54*b*. The pneumatic cylinder 77*b* that actuates said lowering and lifting of the second gripper 54*b* is provided in the portion 66*a* of the supporting element 66.

The portion 66*a* is associated, so that it can slide along a direction that is parallel to the transfer direction 58, with the supporting element 66, and is connected, by means of a threaded shaft 78, whose axis is horizontal and parallel to the transfer direction 58, to a female thread 79 that is formed in a bush 80 that is inserted coaxially in the sleeve 67. The bush 80 is locked axially and can rotate within the sleeve 67, which is rigidly coupled to the pinion 69. The bush 80 is rigidly coupled to a toothed pulley 81, which is connected, by means of a toothed-belt connection 82, to the output shaft of an electric motor 83, which can be actuated in order to turn the bush 80 about the axis 65. This rotation of the bush 80 causes, as a consequence of the threaded coupling with the shaft 78, a translational motion of the portion 66*a* of the supporting element 66 and therefore of the second gripper 54*b* with respect to the first gripper 54*a* parallel to the transfer direction 58. The movement of the second gripper 54*b* with respect to the first gripper 54*a*, parallel to the transfer direction 58, has the effect of causing the article 25 to widen when it is engaged with the grippers 54*a* and 54*b*, and therefore of flattening the region of the article 25 that is engaged by said grippers, as will become better apparent hereinafter.

The transfer element 23 is arranged, along at least one portion of its path along the transfer direction 58, above a feeder guide 84 of a sewing machine, of a known type which is shown only partially for the sake of simplicity, so as to actuate, during its translational motion laterally away from the double-cylinder machine, the insertion of the axial end of the article 25 to be sewn in said feeder guide 84.

The operation of the machine with a device for removing and transferring the article at the end of the knitting process according to the invention is as follows.

For the sake of greater clarity, the operation of the machine according to the invention is described with reference to the production of a hosiery item, without altering the fact that the machine can also be used to manufacture other articles meant to be closed at one of their axial ends.

The hosiery item is produced starting from the top, i.e., from its axial end that lies opposite the axial end or toe to be closed by sewing.

Furthermore, it should be noted that the hosiery item, as usually occurs in conventional manufacturing processes, is finished at the toe by forming a few rows of stitches, or border, that are meant to be removed during sewing and are formed indeed to allow the precise and correct insertion of the toe to be sewn in the feeder guide 84 of a sewing machine.

While the machine is completing the knitting of the article 25, the removal element 22 is inserted and coupled to the upper needle cylinder 4 in its rotation about the axis 3.

Figure 3:
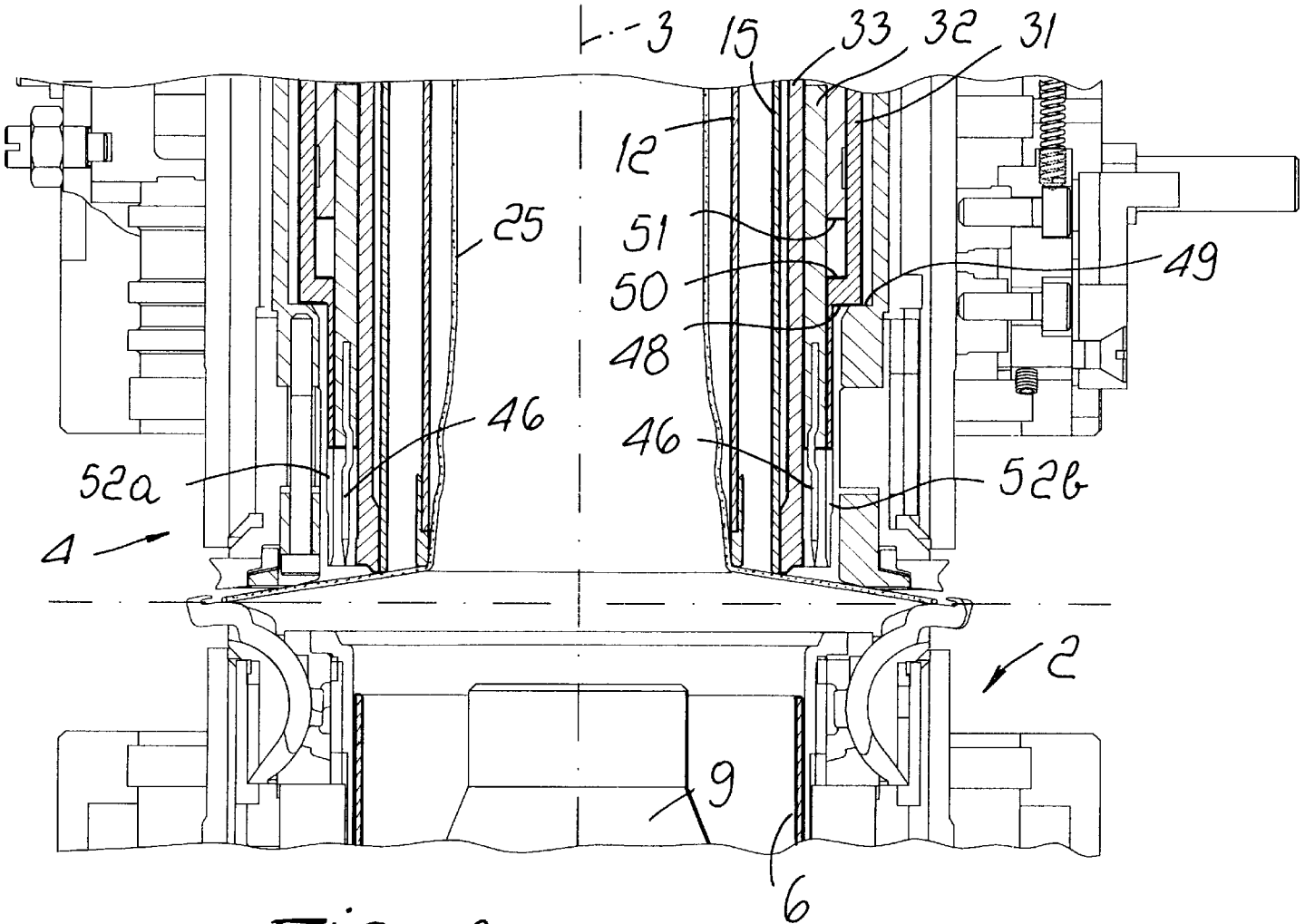
FIG. 3 is an enlarged-scale view of a detail of FIG. 1.

The article 25 is aspirated into the upper tube 12 and is therefore upside down (FIG. 3).

Preferably, while the machine is completing the knitting of the last rows of stitches, the plug-like element 9 is moved, by way of the actuation of the pneumatic cylinder 11, so that it engages the lower end of the upper tube 12, thus locking the article 25. It should be noted that this operation can also be performed in a preceding step, if the intervention of the article tensioning device constituted by the plug-like element 9, the upper tube 12 and the tensioning tube 15 is required.

Figure 4:
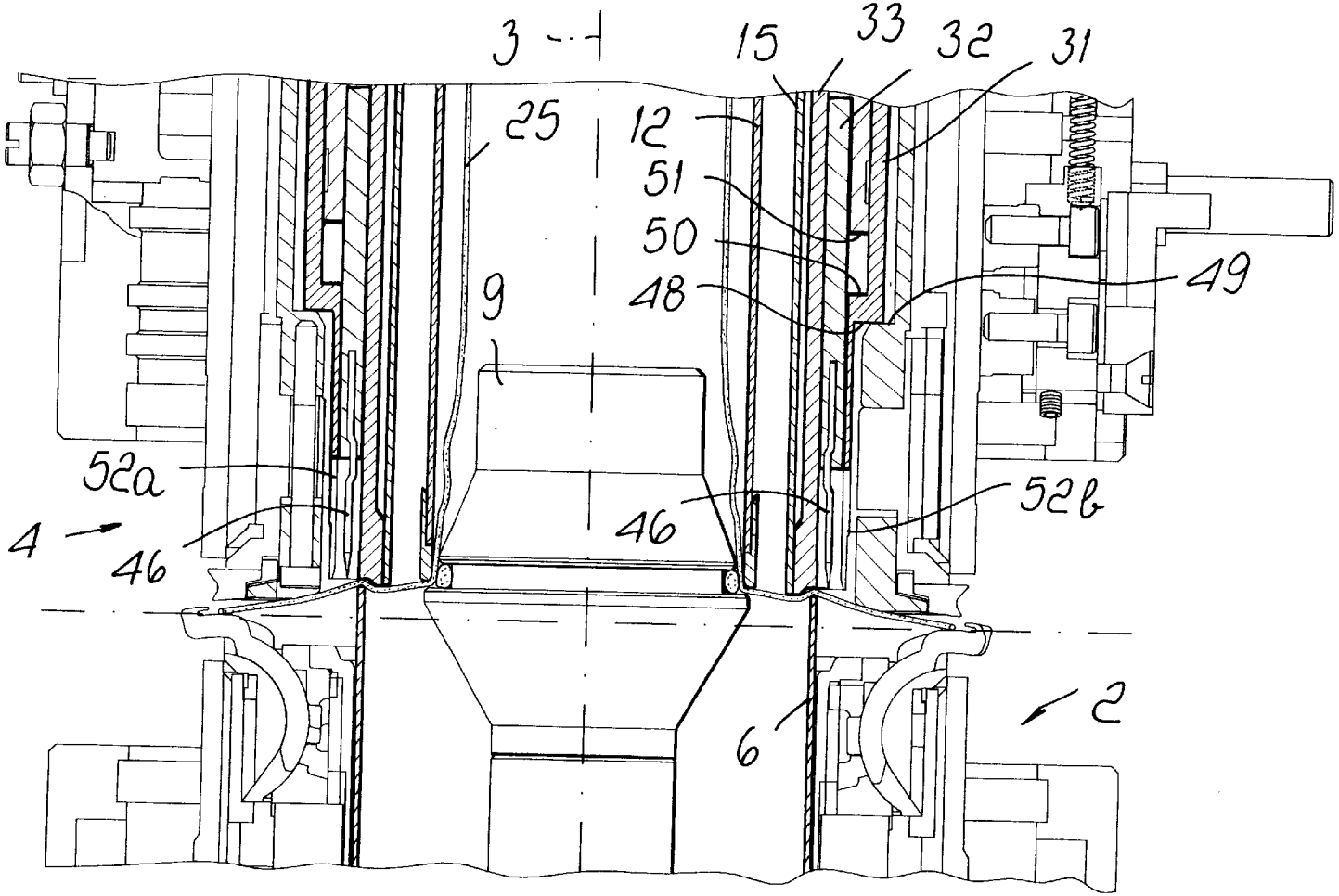
FIG. 4 is a view of the detail of the machine shown in FIG. 2, in a first step of the operation of the article removal element.
Figure 5:
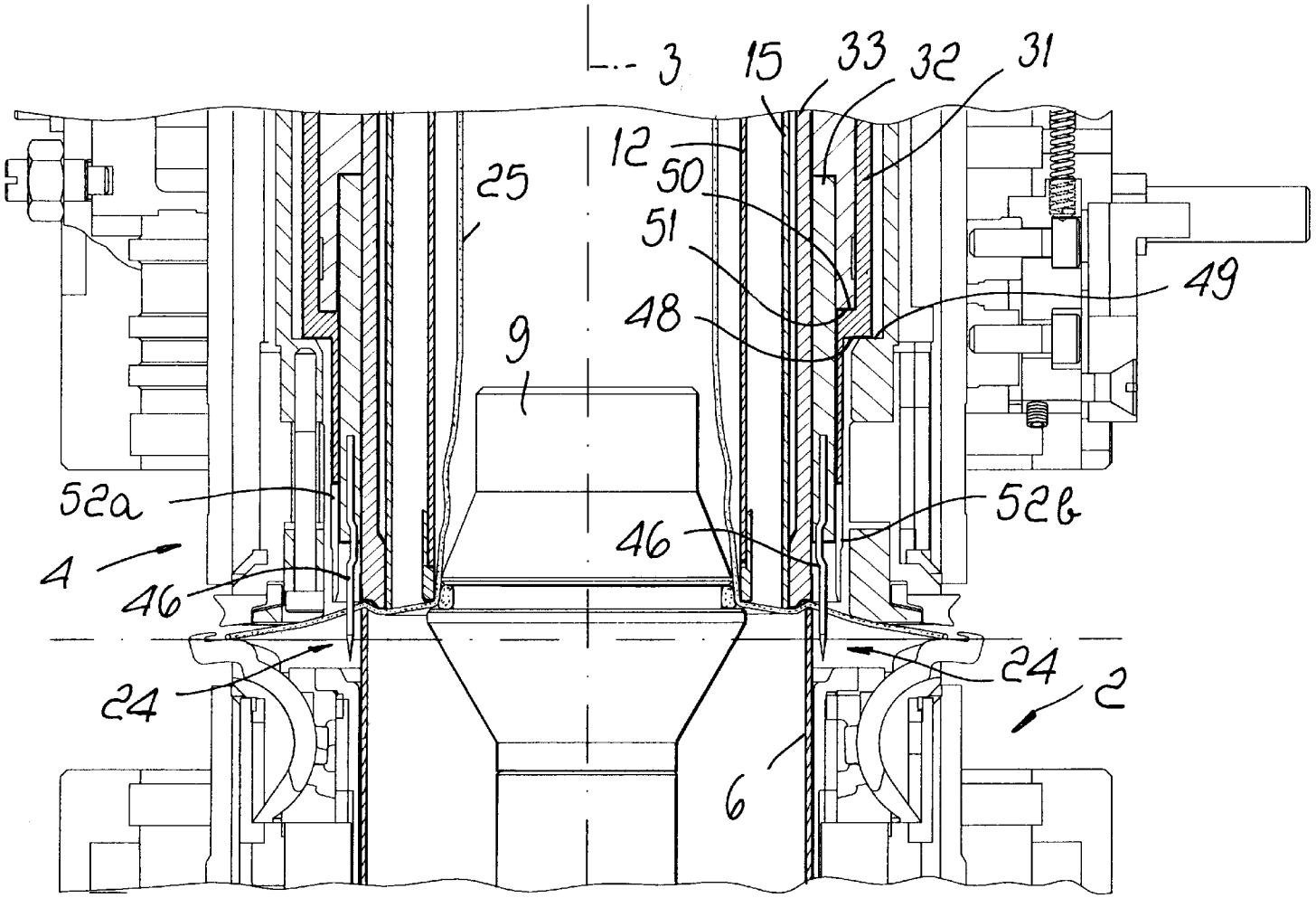
FIG. 5 is a view of the same detail of the machine shown in FIGS. 3 and 4, in a second step of the operation of the removal element.

Then the pneumatic cylinder 7 is actuated, lifting the lower tube 6, which by engaging the lower end of the inner tube 33 produces a further locking of the article 25 (FIG. 4). At this point, the pneumatic cylinder 45 is actuated, causing the descent of the intermediate cylinder 32 and therefore the passage of the punches 46 through the article 25 (FIG. 5).

It should be noted that the passage of the punches 46 through the article 25 occurs while the article 25 is locked by the plug-like element 9, by the upper tube 12, and between the inner cylinder 32 and the lower tube 6 and while the article 25 is still engaged by the needles of the machine. In this manner, the punches 46 assuredly pass through the article 25. The descent of the intermediate cylinder 32 is limited by the abutment 50 of the outer cylinder 31, which in turn rests against the abutment 49. The descent of the intermediate cylinder 32 loads the spring-loaded pistons 47 that are interposed between the intermediate cylinder 32 and the outer cylinder 31.

At this point, the needles of the machine have ended the manufacture of the article 25 and release the last formed row of stitches. Then the pneumatic cylinder 39 is actuated and starts to extract the removal element 22 upwardly from the upper needle cylinder 4. For part of the upward motion of the removal element 22, the lower tube 6 follows the removal element 22, keeping the article 25 locked. Likewise, for part of the upward motion, the plug-like element 9 follows the removal element 22, also keeping the article 25 locked in the upper tube 12.

Figure 6:
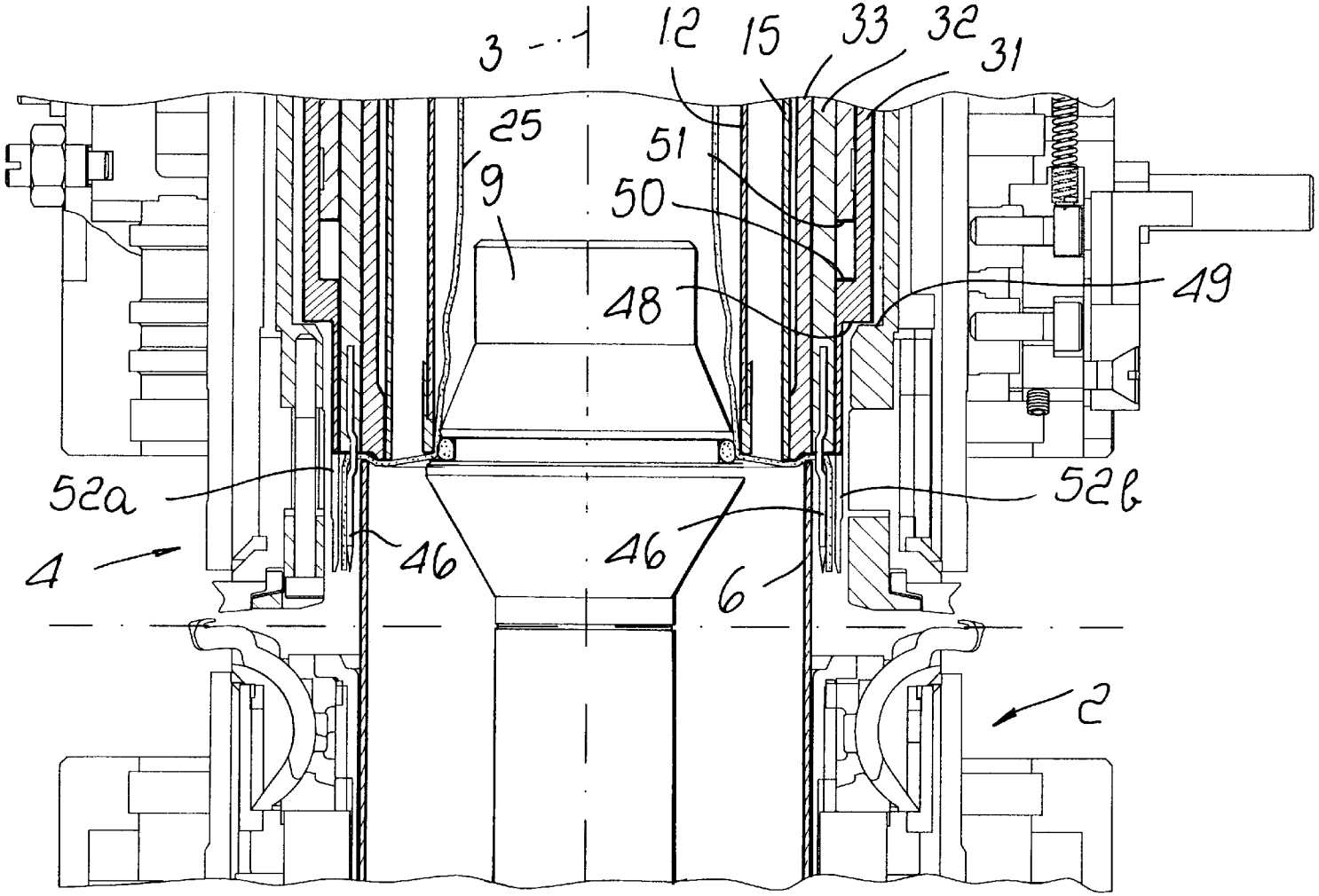
FIG. 6 is a view of the same detail of the machine in a third step of the operation of the removal element.
Figure 7:
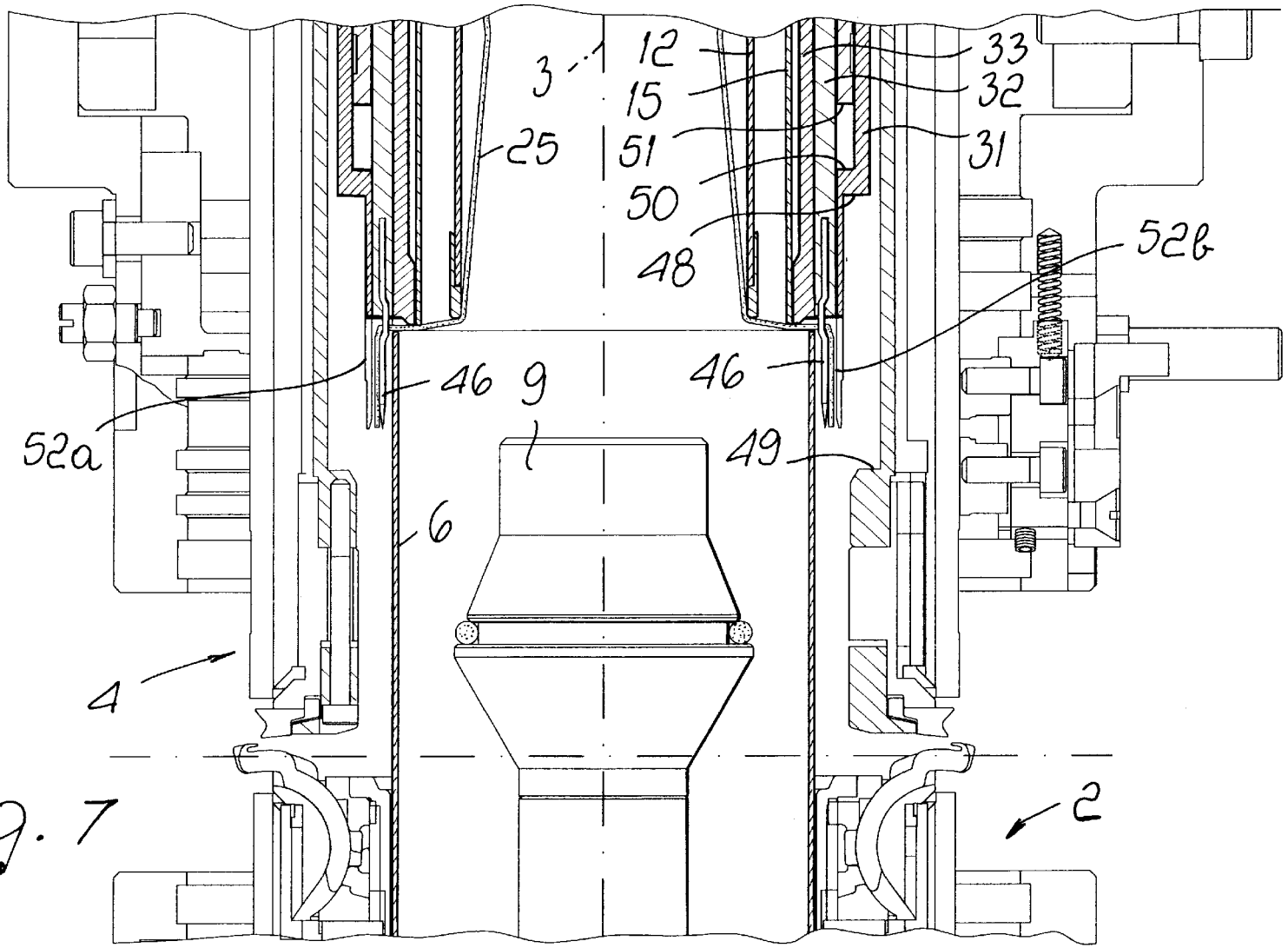
FIG. 7 is a view of the same detail of the machine shown in FIGS. 3 to 6, with the removal element in a fourth step of operation.

It should be noted that at the beginning of the upward motion of the removal element 22 the outer cylinder 31 is kept against the abutment 49, by way of the action of the spring-loaded pistons 47, while the remaining part of the removal element 22 is rising. For this reason, the lower end of the outer cylinder 31 gradually descends below the tip of the punches 46, bending downward the rim of the article 25 that lies outside the punches 46 and protecting said rim from contact with other elements of the machine during its extraction (FIGS. 6 and 7).

The upward motion of the removal element 22 continues until the removal element 22 is fully extracted upward from the upper needle cylinder 4. It should be noted that the disengagement of the removal element 22 from the upper needle cylinder 4 and the disengagement of the plug-like element 9 from the upper tube 12 have the effect of disengaging these two elements in rotation about the axis 3; therefore, once the removal element 22 has been extracted upwardly from the upper needle cylinder 4, it can be in any angular position around the axis 3. For this reason, the motor 55 is actuated, arranging the removal element 22 in a preset angular position around the axis 3. Said preset angular position is such as to move the passages 52*a* and 52*b* of the outer cylinder 31 into alignment with the grippers 54*a* and 54*b* mounted on the transfer element 23.

Figure 8:
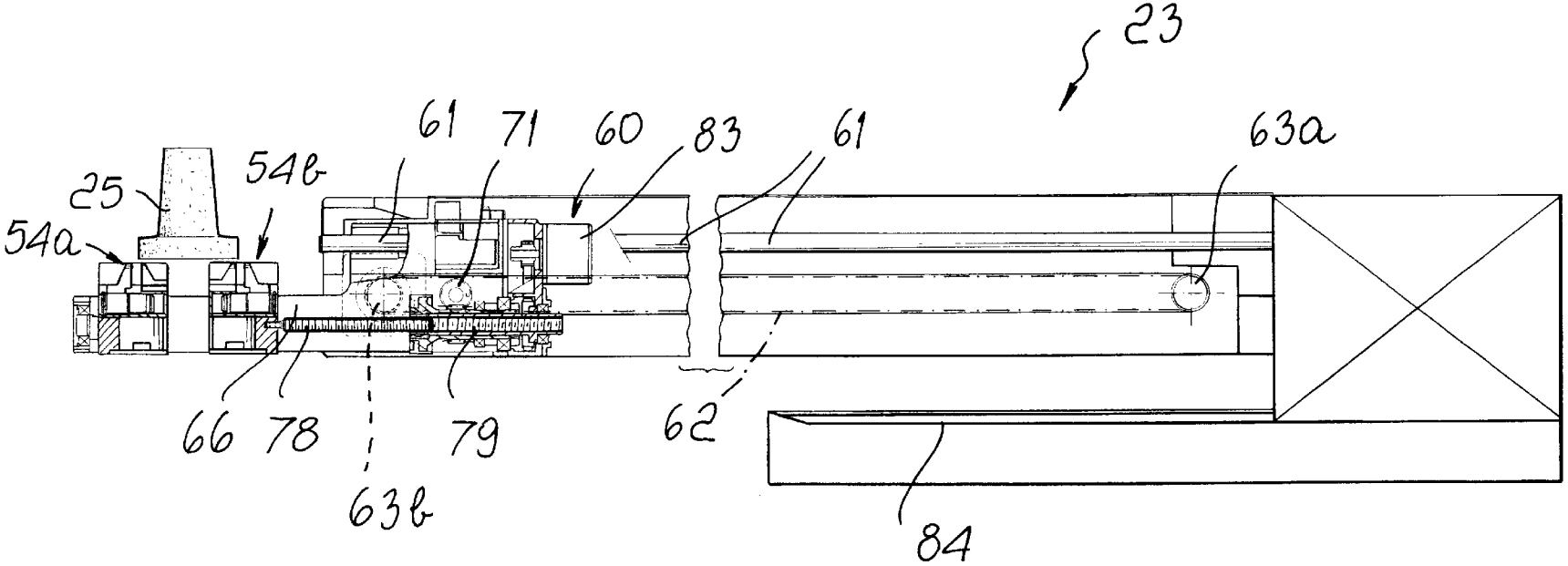
FIG. 8 is a partially sectional lateral elevation view of the transfer element.
Figure 9:
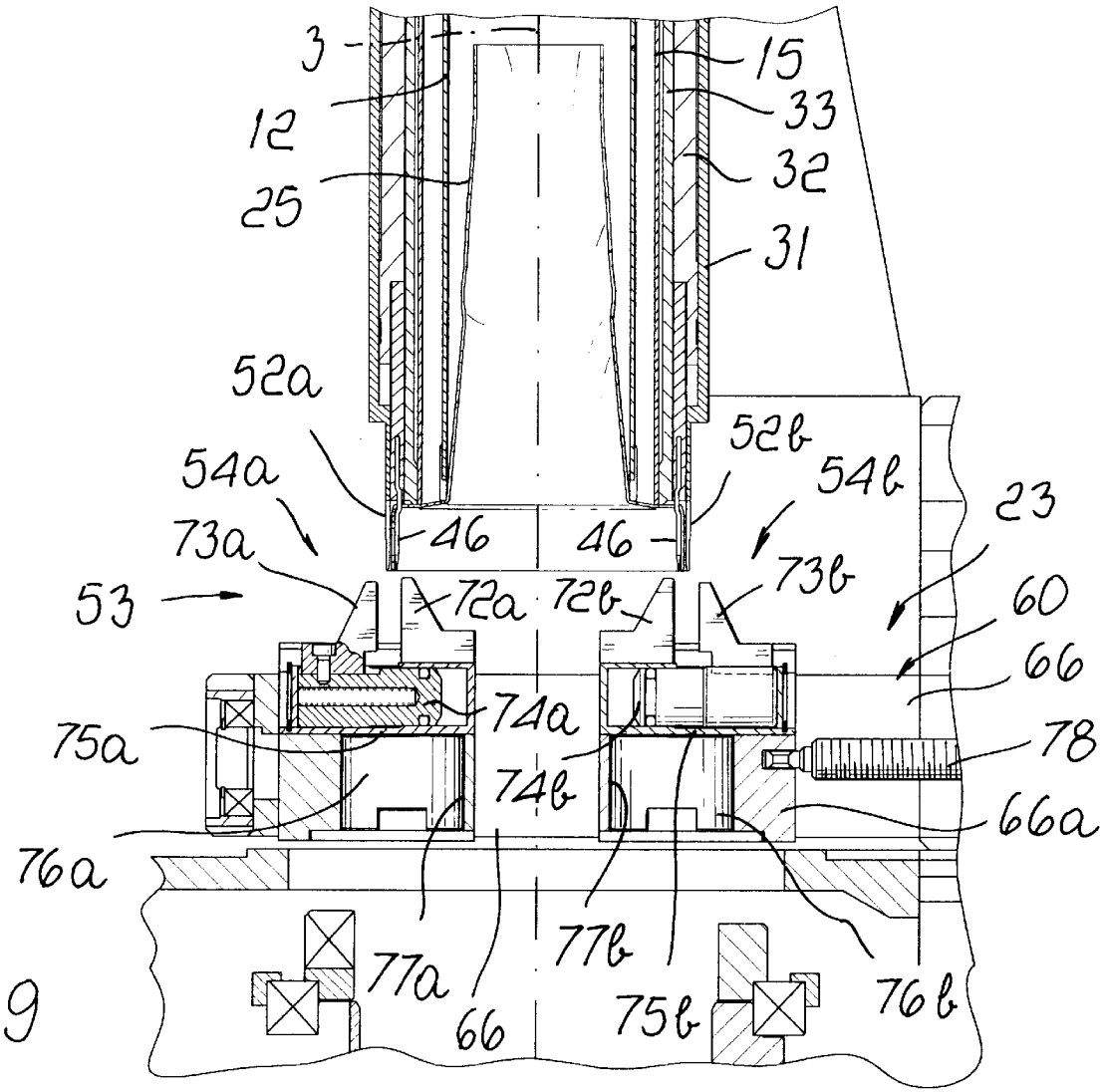
FIG. 9 is an enlarged-scale view of a detail of FIG. 8 in a first step of the operation of the transfer element.

At this point, the grippers 54*a* and 54*b*, by way of the actuation of the belt 62, are arranged below the lower end of the removal element 22, with the jaws 73*a* and 73*b* spaced from the jaws 72*a* and 72*b* (FIGS. 8 and 9). The grippers 54*a* and 54*b*, previously in the lowered position, are raised by way of the actuation of the pistons 76*a* and 76*b* of the cylinders 77*a* and 77*b* so as to insert the jaws 72*a* and 72*b* in the article 25.

Figure 10:
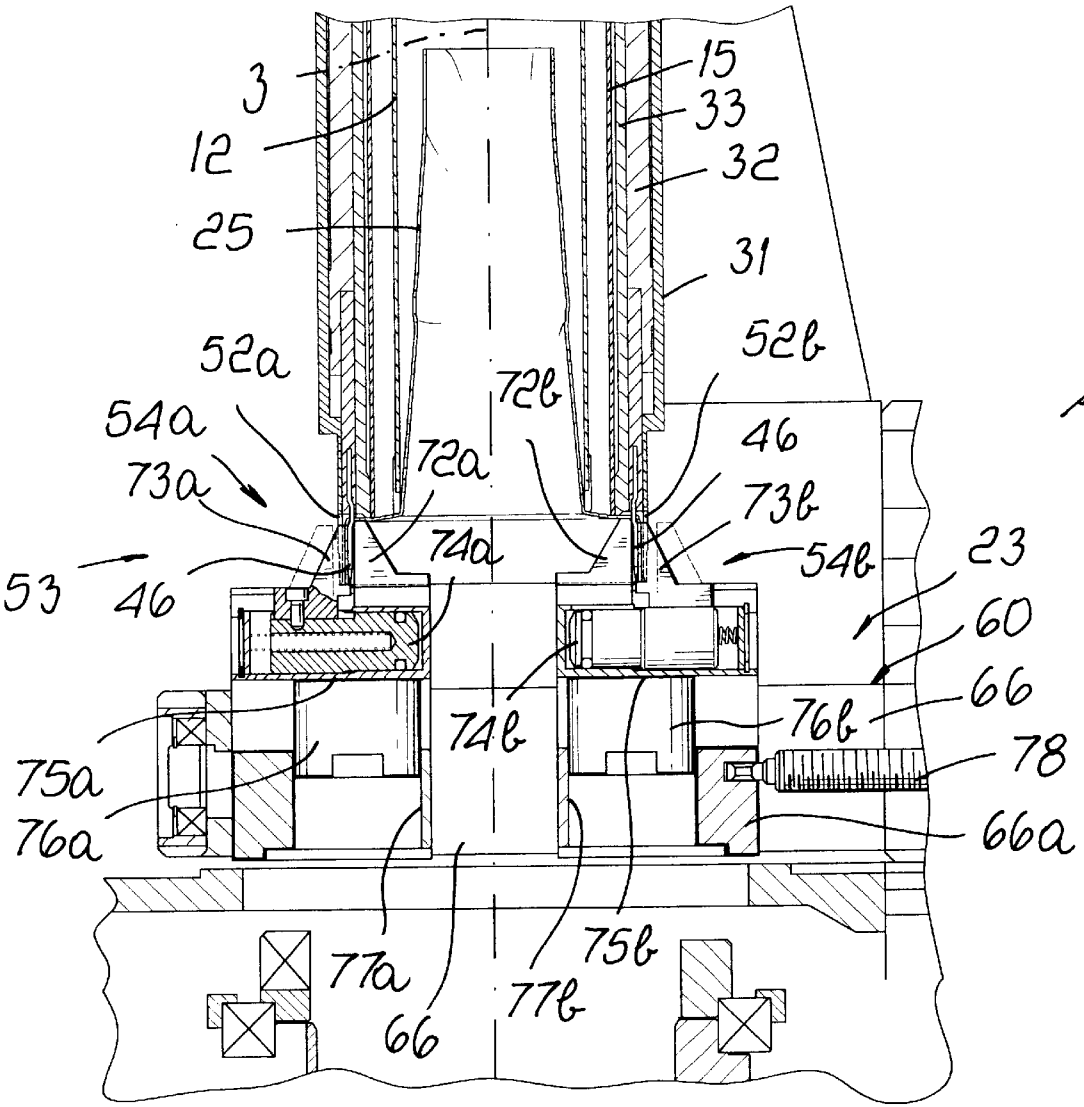
FIG. 10 is a view of the same detail of FIG. 9, in a second step of the operation of the transfer element.

Then the pistons 74*a* and 74*b* of the cylinders 75*a* and 75*b* are actuated, moving the jaws 73*a* and 73*b* toward the jaws 72*a* and 72*b*, gripping the regions of the article that are located at the passages 52*a* and 52*b* (FIG. 10).

At this point, by way of the actuation of the pistons 76*a* and 76*b* of the cylinders 77*a* and 77*b*, the grippers 54*a* and 54*b* are lowered and at the same time the intermediate cylinder 32, by way of the actuation of the pneumatic cylinder 45, is lifted together with the outer cylinder 31, so that the article 25 disengages assuredly from the removal element 22 and remains anchored to the grippers 54*a* and 54*b*.

Figure 11:
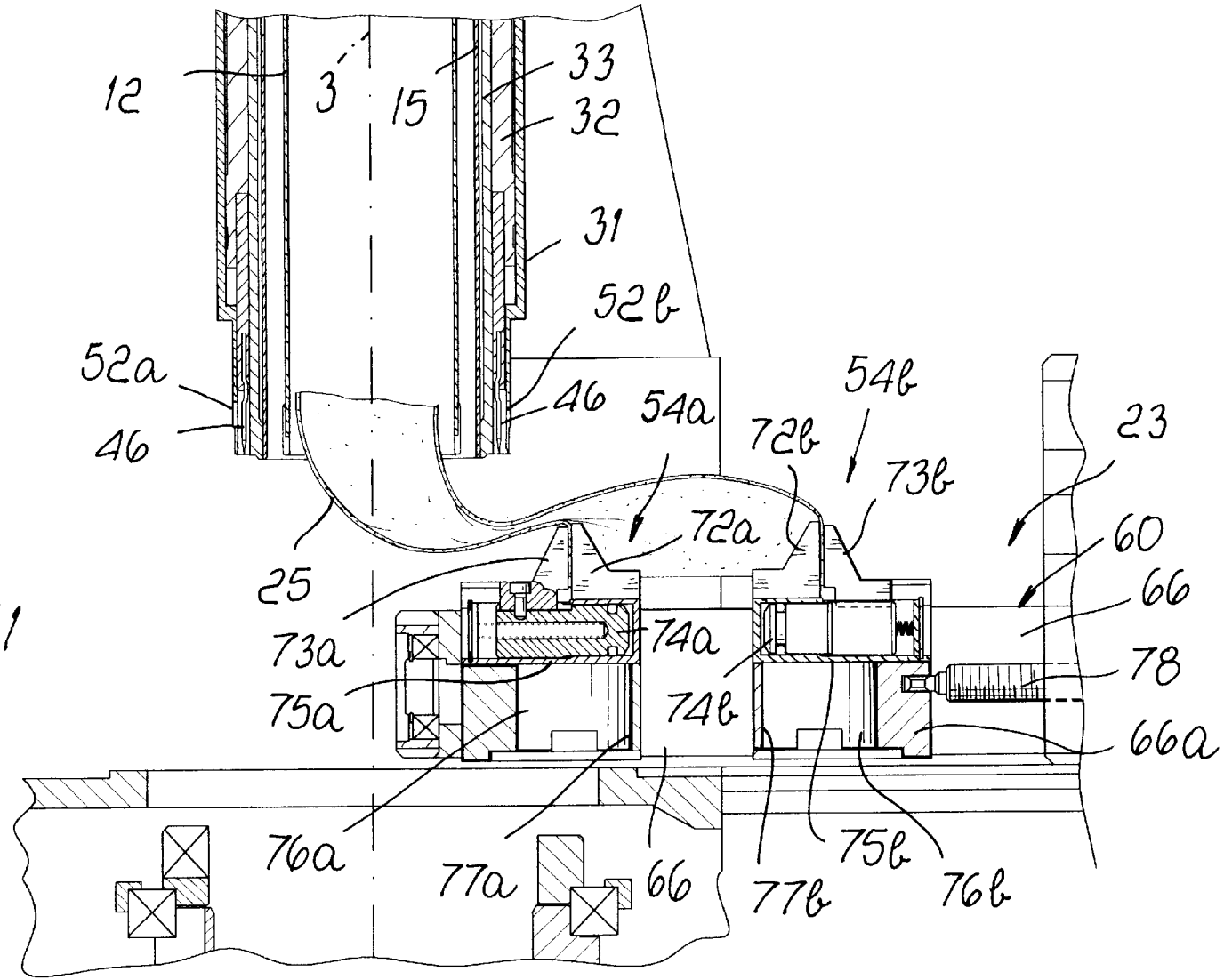
FIG. 11 is a view of the same detail of FIGS. 9 and 10, in a third step of the operation of the transfer element.

The grippers 54*a* and 54*b*, by way of the actuation of the belt 62, are moved away, along the transfer direction 58, laterally to the machine, actuating the extraction of the article 25 from the upper tube 12 (FIG. 11).

Once the article 25 has been removed by the grippers 54*a* and 54*b*, the removal element 22 is lowered again and inserted in the upper needle cylinder 4, coupling to the tooth 42 in the seat 43*a*. The tooth 42 is positioned correctly with respect to the seat 43*a* by way of the actuation of the motor 55.

During this movement of the grippers 54*a* and 54*b* away from the machine, the rack 70 is also actuated and, by causing the rotation of the grippers 54*a* and 54*b* about the horizontal axis 65, turns over the article 25, orientating it so that the border, i.e., the end to be sewn, is directed upward. At the same time, or in any case during the movement of the transfer element 23 along the guiding bars 61 away from the double-cylinder machine, the motor 83 is also actuated and, by causing the rotation of the bush 80, causes the movement of the second gripper 54*b* away from the first gripper 54*a*, tensioning the article 25 at the region gripped by the grippers 54*a* and 54*b* and thus causing its flattening, with mutual movement of the two flaps of the border stretched between said grippers.

Figure 12:
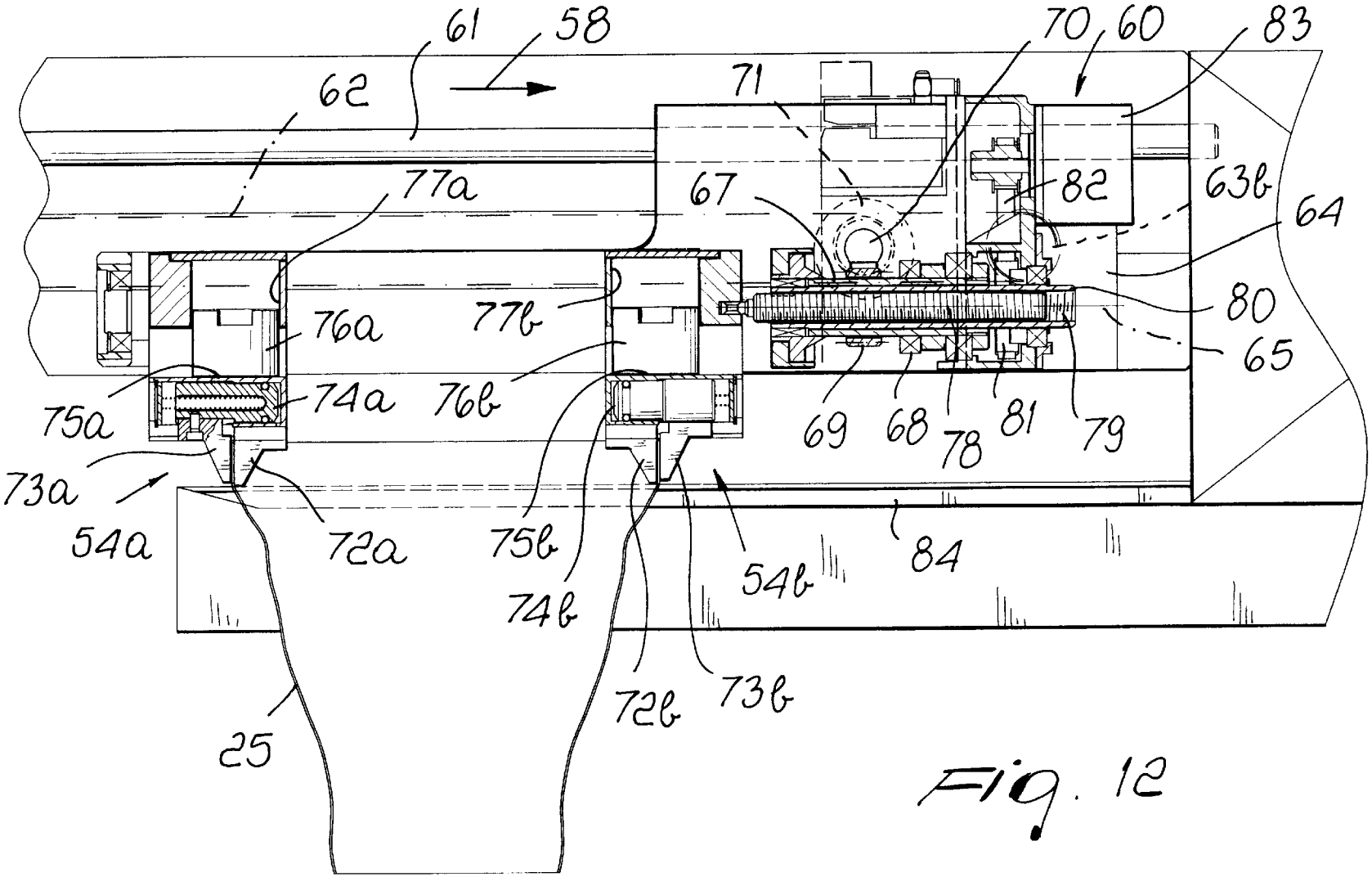
FIG. 12 is another view of the same detail of FIGS. 8 to 11, in a fourth step of the operation of the transfer element.

In the final portion of the translational motion of the transfer element 23 along the guiding bars 61, the article 25 is inserted, with its portion proximate to the end gripped by the grippers 54*a* and 54*b*, into the feeder guide 84 of the sewing machine (FIG. 12).

At this point, the article 25 is released by the grippers 54*a* and 54*b* and its advancement along the feeder guide 84 of the sewing machine is performed by way of means of a known type with which the sewing machine is provided and which are not described for the sake of brevity.

It should be noted that after the lower tube 6, together with the plug-like element 9, has been returned into the lower needle cylinder 2, i.e., while the removal element 22 is still completing the extraction of the article 25 from the upper needle cylinder 4, the machine can resume knitting, starting to form a new article. The article being manufactured in this step can be tensioned by applying suction to the lower tube 6.

In this manner, the time during which the machine is not manufacturing is reduced significantly with respect to the unproductive times that can be observed in currently commercially available machines capable of performing the automated transfer of articles from the manufacturing machine to a sewing machine in order to close an axial end of the articles.

In practice it has been found that the machine with device for removing and transferring the article at the end of the knitting process according to the invention fully achieves the intended aim, since by reducing considerably the time during which the machine is unable to manufacture an article due to the transfer of the previously manufactured article, it is not penalized or is penalized to a minimal extent as regards its productivity.

The machine with device for removing and transferring the article thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2002A001384 from which this application claims priority are incorporated herein by reference.

What is claimed is:

1. A circular double-cylinder hosiery knitting machine comprising: a lower needle cylinder, which has a vertical axis; an upper needle cylinder, which is arranged above said lower needle cylinder and coaxially thereto, said needle cylinders being actuatable with a rotary motion about said vertical axis; and a device for removing and transferring a knitted article, said removing and transfer device being provided with a removal element that is insertable from above into the upper needle cylinder and being removable upwardly from the upper needle cylinder in order to move the article away from the machine, said removal element having first grip means for engaging a region of the article being manufactured that is proximate to a final end of the article, and with a transfer element which is arranged above the upper needle cylinder to remove the article from said removal element and to feed the removed article to a sewing machine in order to close the final end of the article.

2. The machine of claim 1, wherein said removal element comprises aspiration means for aspirating the article upward and for arranging the article upside down, inside the upper needle cylinder, before engagement of the final end of the article by way of said first grip means.

3. The machine of claim 2, wherein said first grip means comprise at least two pairs of grip elements for engaging two mutually diametrically opposite regions of the article, grip elements of a same pair being mutually spaced in order to leave a portion of the article free between two grip elements of a same pair, said transfer element being provided with second grip means for engaging the free portion of the article located between two grip elements of a same pair of grip elements.

4. The machine of claim 2, wherein said removal element is insertable in said upper needle cylinder and coupleable thereto for rotation about said vertical axis thereof; said removal element being rotationally coupleable with said upper needle cylinder in a preset angular position about the vertical axis of the needle cylinders with respect to an angular position of said upper needle cylinder.

5. The machine of claim 3, further comprising first locking means for locking the article on said removal element before engagement thereof by way of said first grip means, said first locking means being adapted to engage a region of the article that is closer to said vertical axis than a region that is engaged by said first grip means.

6. The machine of claim 5, further comprising second locking means for locking the article on said removal element before engagement thereof by said first grip means, said second locking means being adapted to engage a region of the article that is located between the region that is engaged by said first grip means and the region that is engaged by said first locking means.

7. The machine of claim 6, wherein said removal element comprises a hollow inner cylinder, a hollow intermediate cylinder, and a hollow outer cylinder all of which have a vertical axis; said hollow inner, intermediate and outer cylinders being coaxial and being insertable and extractable on command coaxially in and from said upper needle cylinder.

8. The machine of claim 7, wherein said hollow inner, intermediate and outer cylinders are coupled to each other for joint rotation about said vertical axis.

9. The machine of claim 5, wherein said first grip means comprise punches that are connected to a lower axial end of said hollow intermediate cylinder and are directed with tips thereof downward, cylinder actuation means being provided for actuating said hollow intermediate cylinder along said vertical axis with respect to said hollow inner cylinder in order to move the intermediate cylinder from an inactive position, in which said punches are arranged with the tips thereof at a higher level than a lower axial end of said hollow inner cylinder, to an active position, in which said punches are arranged with the tips thereof below a lower axial end of said hollow inner cylinder in order to engage the article, and vice versa.

10. The machine of claim 9, wherein said hollow outer cylinder is movable axially with respect to said hollow intermediate cylinder in order to pass from a raised position, in which a lower axial end thereof is substantially at a level of the tips of said punches, to a lowered position, in which the lower axial end lies below the tips of said punches, elastic means being provided between said intermediate and outer cylinders which contrast passage of said hollow outer cylinder from said lowered position to said raised position.

11. The machine of claim 2, wherein said aspiration means for aspirating the article upward comprises an upper suction tube, which is arranged internally and coaxially to said hollow inner cylinder.

12. The machine of claim 6, wherein said first locking means comprise a plug element that is arranged coaxially to said needle cylinders; said plug element being movable, on command, along the axis of the needle cylinders from an inactive position, in which said plug element is accommodated in said lower needle cylinder and is spaced downward from a lower end of said upper suction tube, to an active position, in which the plug engages a lower end of said upper suction tube in order to lock said article between said upper suction tube and said plug element.

13. The machine of claim 12, wherein said plug element is at least partially movable axially and jointly with said removal element in order to maintain locking of the article at least along part of an upward motion of said removal element.

14. The machine of claim 10, wherein said second locking means comprise a lower suction tube, which is accommodated coaxially in said lower needle cylinder and is movable axially with respect to the lower needle cylinder in order to engage or disengage a lower end of said hollow inner cylinder in order to lock the article between the lower end of said hollow outer cylinder and an upper end of said lower suction tube.

15. The machine of claim 14, wherein said lower suction tube is at least partially movable axially and jointly with said removal element in order to maintain locking of the article at least along part of an upward motion of said removal element.

16. The machine of claim 15, comprising removal actuation means for actuating said removal element with a controlled rotary motion about said vertical axis in order to position said removal element in a preset angular position around said vertical axis.

17. The machine of claim 16, wherein said transfer element is selectively actuatable to move on command along a substantially horizontal transfer direction that forms a path from a position for gripping the article, in which the transfer element is arranged with said second grip means below a lower end of said removal element in a position in which the removal element is extracted upward from the upper needle cylinder, to a transfer position, in which the transfer element is moved laterally away from the upper needle cylinder, and vice versa.

18. The machine of claim 17, further comprising a feeder guide for a sewing machine, located along at least one portion of the path of said transfer element and below said path, so as to allow insertion of a portion of the article in said feeder guide during passage of said transfer element from an article grip position to a transfer position.

19. The machine of claim 17, wherein said second grip means of the transfer element comprise a supporting element that is movable on command along said transfer direction, and two grippers which are mounted on said supporting element.

20. The machine of claim 19, wherein said two grippers are provided with jaws and are movable on command along a substantially vertical direction with respect to said supporting element in order to enter with one of said jaws of each one of said grippers through a lower end of said hollow outer cylinder.

21. The machine of claim 19, wherein a first gripper of said two grippers is movable on command away from a second one of said grippers in order to widen the region of the article that is engaged by said grippers.

22. The machine of claim 19, wherein each gripper of said two grippers comprises a first jaw and a second jaw that face each other, one of said jaws being movable on command toward or away from the other jaw in order to engage or disengage free portions of the article between two grip elements of a same pair of grip elements of said first grip means.

23. The machine of claim 22, wherein said two grippers are rotatable on command about a substantially horizontal axis, said horizontal axis being parallel to said transfer direction, in order to overturn the article upon removal thereof from said removal element.

24. The machine of claim 19, wherein said hollow outer cylinder has, starting from its lower end, two passages located in two mutually diametrically opposite regions thereof in order to allow engagement of said two grippers with the article.

25. A method for automated transfer of a tubular article, from a circular double-cylinder machine to a sewing machine, comprising the steps of:

sewing the article, while the last rows of stitches of the article are produced, at its axial or final end to be closed;

aspirating the article into the upper needle cylinder;

gripping the article proximate to its final end by means of a removal element that can be extracted upward from the upper needle cylinder;

disengaging the article from the needles of the machine that have manufactured it;

extracting the article upwardly from the upper needle cylinder by way of said removal element;

engaging the article at its final end by way of a transfer element;

disengaging the article from said removal element and inserting the article, by way of said transfer element, with a region proximate to its final end, in the feeder guide of the sewing machine.

26. The method of claim 25, wherein said article is gripped, proximate to the final end thereof, by said removal element before ending said sewing step for manufacturing the article.

27. The method of claim 25, comprising before completing extraction of the article from the upper needle cylinder, actuation of the machine to start manufacturing of a new article.

28. The method of claim 26, comprising after said transfer element has gripped the article, flattening of said final end of the article by tensioning a region of the article that is engaged by said transfer element.

29. The method of claim 28, comprising after engagement of said transfer element with the article and disengagement thereof from said removal element, turning over the article for arranging the final end thereof above a remaining part of the article.

* * * * *